US008936098B2

(12) United States Patent
Howell et al.

(10) Patent No.: US 8,936,098 B2
(45) Date of Patent: Jan. 20, 2015

(54) SYSTEM AND METHOD FOR REMEDIATING A WELLBORE ANNULUS

(75) Inventors: James J. Howell, Houston, TX (US); Mahesha Udipi, Houston, TX (US); Mark Viator, Houston, TX (US); Eugene Borak, Houston, TX (US); David Comeaux, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 704 days.

(21) Appl. No.: 12/910,191

(22) Filed: Oct. 22, 2010

(65) Prior Publication Data

US 2012/0097390 A1 Apr. 26, 2012

(51) Int. Cl.

| | |
|---|---|
| ***E21B 19/22*** | (2006.01) |
| ***E21B 33/08*** | (2006.01) |
| ***E21B 33/068*** | (2006.01) |
| ***E21B 17/20*** | (2006.01) |

(52) U.S. Cl.

CPC ..... *E21B 17/20* (2013.01); *E21B 33/08* (2013.01); *E21B 33/068* (2013.01)

USPC ..... 166/385; 166/242.2; 166/77.1

(58) Field of Classification Search

USPC ..... 166/384, 385, 242.2, 77.1

See application file for complete search history.

(56) References Cited

U.S. PATENT DOCUMENTS

| | | | | |
|---|---|---|---|---|
| 4,972,904 | A * | 11/1990 | Godare | 166/90.1 |
| 5,927,405 | A | 7/1999 | Monjure et al. | |
| 6,186,239 | B1 | 2/2001 | Monjure et al. | |
| 6,289,992 | B1 | 9/2001 | Monjure et al. | |
| 7,069,995 | B2 | 7/2006 | Chan | |
| 7,686,091 | B2 | 3/2010 | Jennings | |
| 2005/0155766 | A1 * | 7/2005 | Vuyk et al. | 166/311 |
| 2009/0288832 | A1 | 11/2009 | Comeaux | |
| 2010/0000730 | A1 | 1/2010 | Jennings | |
| 2010/0018721 | A1 | 1/2010 | Jennings et al. | |

FOREIGN PATENT DOCUMENTS

GB 2460329 A 12/2009

OTHER PUBLICATIONS

GB Search Report issued Nov. 17, 2011 from corresponding Application No. GB1118049.4.

* cited by examiner

*Primary Examiner* — Catherine Loikith

(74) *Attorney, Agent, or Firm* — Bracewell & Giuliani LLP

(57) ABSTRACT

A casing annulus remediation hose assembly having a hose with an inlet in selective fluid communication with a fluid supply and an exit connected to a nozzle. On the nozzle is an insertion tip for facilitating insertion and retrieval of the hose assembly in and out of an annulus in a wellhead assembly. The insertion tip has an outer annular flexible housing that is coaxially attached to the nozzle and spherical weighted members arranged in series in the housing. A cable extends coaxially from a downstream end of the nozzle and through each weighted member.

19 Claims, 3 Drawing Sheets

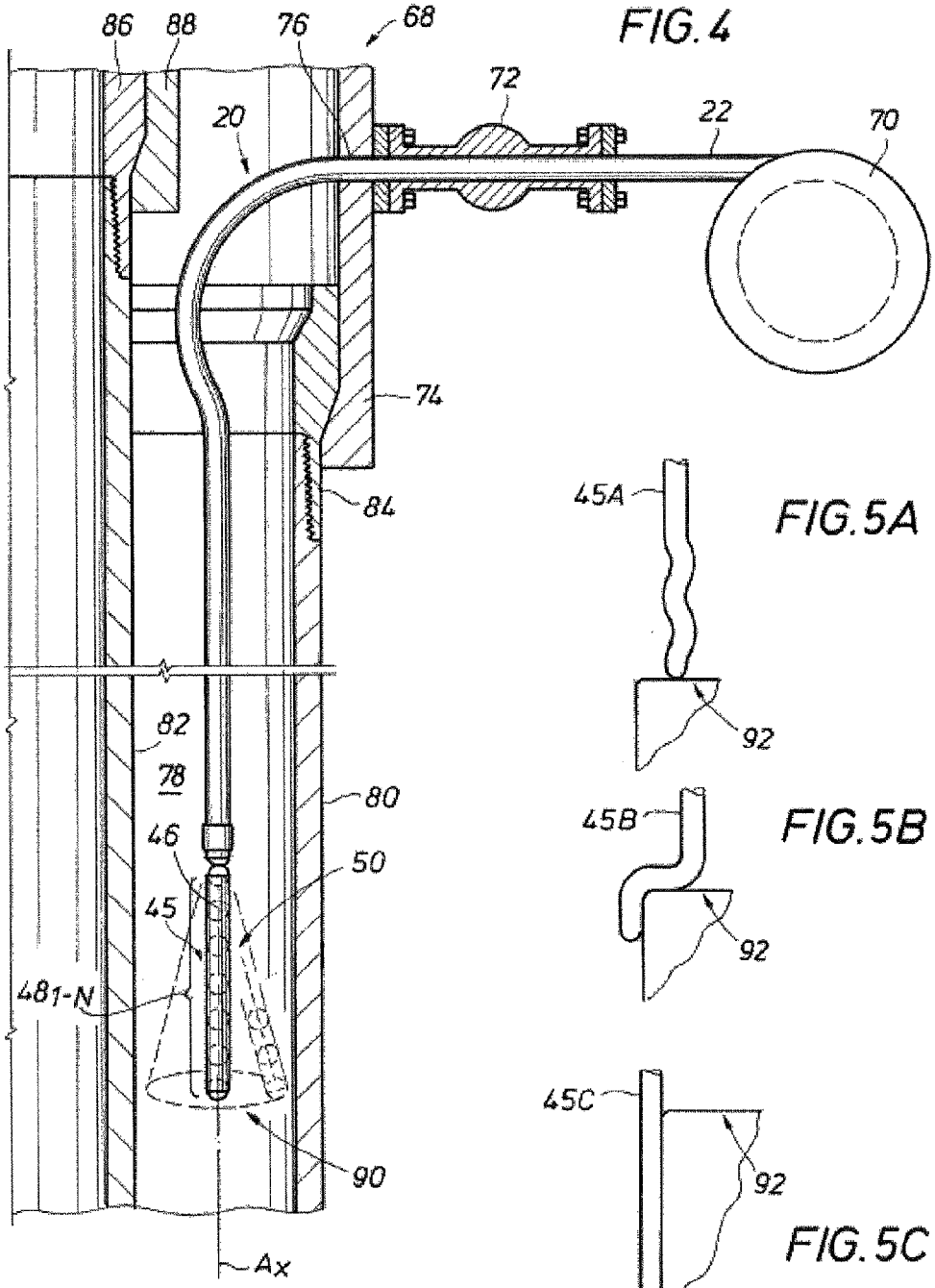
FIG. 4
FIG. 5A
FIG. 5B
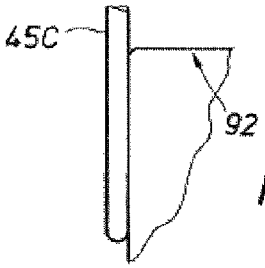
FIG. 5C

SYSTEM AND METHOD FOR REMEDIATING A WELLBORE ANNULUS

FIELD OF INVENTION

The device described herein relates generally to the production of oil and gas. More specifically, the present disclosure relates to a system and method for deploying a casing annulus remediation system.

DESCRIPTION OF RELATED ART

Hydrocarbon producing wellbores have casing lining the wellbore and production tubing suspended within the casing. Some wellbores may employ multiple well casings of different diameters concentrically arranged in the wellbore. In some instances, a casing string may develop a leak thereby pressurizing an annulus between the leaking casing string and adjacent casing. Other sources of leaks include tubing, packers, wellhead packoffs, and faulty casing cement bond.

Pressure in the annulus can be controlled by introducing a high specific gravity fluid into the annulus, thereby isolating the wellhead from the pressure. In addition to adding fluid directly to the top of the annulus through a wellhead, hydraulic hose systems have been used to inject fluid into the pressurized annulus. The hose generally includes a nozzle element lowered proximate to the annulus bottom where the fluid is discharged from the hose. Typically the hose is stored on a reel from which it is unrolled, and then inserted through an entry in the wellhead. The lower end of the hose will often include a series of articulated weights connected together in series.

SUMMARY OF INVENTION

The device disclosed herein includes a casing annulus remediation hose assembly having a hose with an inlet in selective fluid communication with a fluid supply and an exit connected to a nozzle. On the nozzle is an insertion tip for facilitating insertion and retrieval of the hose assembly in and out of an annulus in a wellhead assembly. The insertion tip has an outer annular flexible housing that is coaxially attached to the nozzle and spherical weighted members arranged in series in the housing. A cable extends coaxially from a downstream end of the nozzle and through each weighted member.

Also disclosed is a method that includes remediating an annulus in a wellhead assembly by providing a flexible hose having a lower end with a nozzle and an insertion tip comprising weighted spheres mounted in-line on an elongated flexible element and a flexible housing covering the spheres. The method further includes inserting the lower end of the flexible hose inside of a wellhead assembly, and contacting a surface in the annulus with the insertion tip by lowering the flexible hose so that the insertion tip flexes against the surface and drops downward lower within the annulus at an edge of the surface thereby guiding the lower end of the flexible hose past the surface, and providing a fluid flow through the hose that exits the nozzle into the annulus.

BRIEF DESCRIPTION OF DRAWINGS

Some of the features and benefits of the present invention having been stated, others will become apparent as the description proceeds when taken in conjunction with the accompanying drawings, in which:

FIG. 4 is a side partial sectional view of an embodiment of the hose assembly of FIG. 1 in use within a wellhead assembly.

FIGS. 5A-5C are schematic illustrations of an example of an end of the hose assembly sliding past an edge in an annulus.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
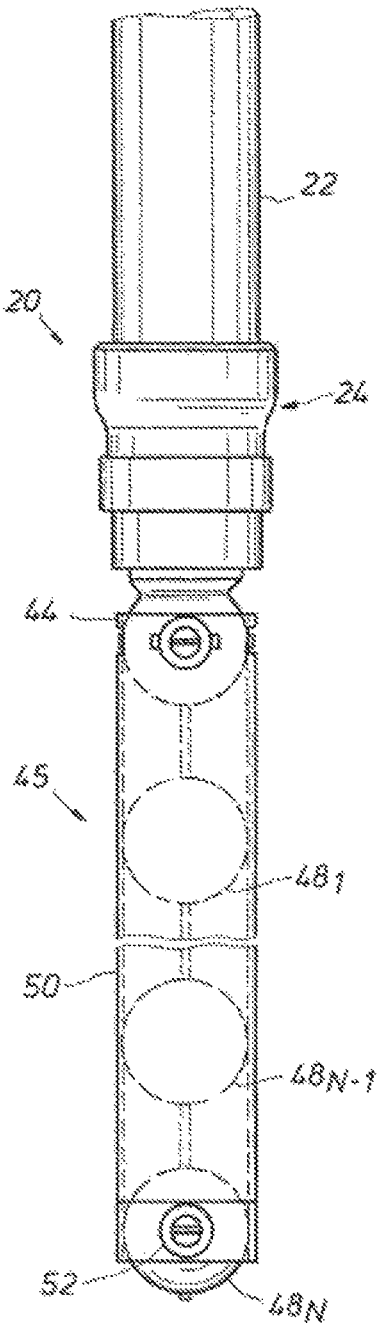
FIG. 1 is a view of an embodiment of a casing annulus remediation hose assembly in accordance with the present disclosure.
Figure 2:
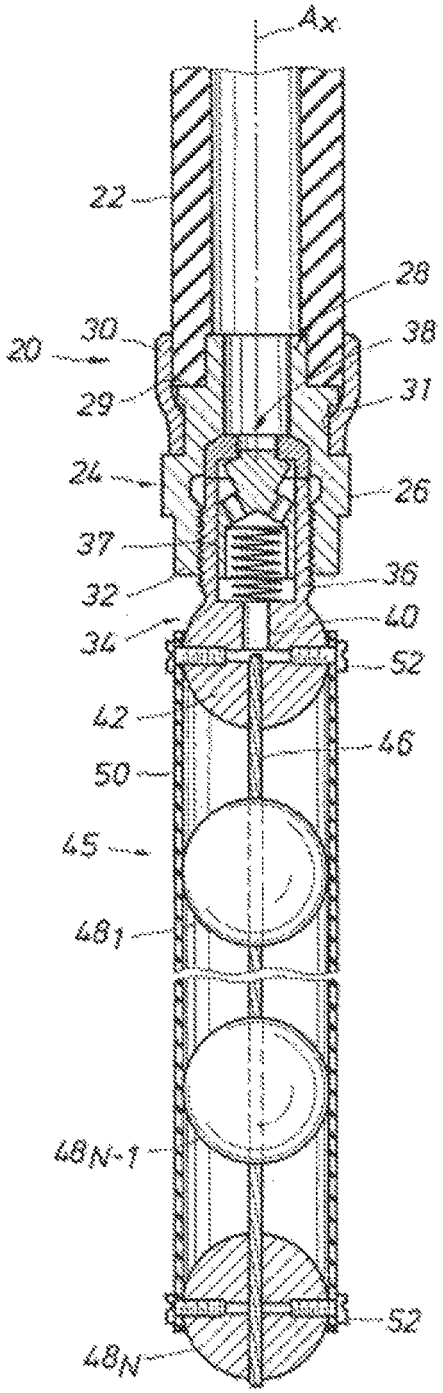
FIG. 2 is a sectional view of the hose assembly of FIG. 1.

Shown in a side view in FIG. 1 is an example embodiment of a portion of a casing annulus remediation (CAR) hose assembly 20 for use in a wellbore assembly. The portion of the CAR hose assembly 20 shown in FIG. 1 includes a lower end of a flexible hose 22 having a fitting 24 mounted on the end of the hose 22. Referring now to FIG. 2, the portion of the CAR hose assembly 20 of FIG. 1 is illustrated in a side sectional view 90° from the view of FIG. 1. The fitting 24 includes an annular body 26 with an outer and inner diameter that both increase and decrease at transition points along the length of the body 26. An upstream end of the body 26 defines a fluid inlet 28 shown inserted within the lower end of the hose 22. Adjacent the fluid inlet 28, the outer diameter of the body 26 transitions radially outward to form a shoulder 29 that contacts the lower terminal end of the hose 22.

An annular skirt 30 mounts to the body 26 in a groove 31 formed on the outer surface of the body 26. The skirt 30 extends from the groove 31 and coaxially past the shoulder 29 where it is crimped against the end of the hose 22 to wedge the hose between the skirt 30 and the inlet side 28. An outlet side 32 is on the body 26 on an end opposite the inlet side 28 in which a nozzle 34 is threadingly attached. Nozzle 34 has an annular base 36 that is set within the outlet side 32 of the body 26. A receptacle 37 is in the annular base 36 and profiled to receive a valve assembly 38. The nozzle 34 further includes a spherical head portion 42 mounted on the annular base 36; a passage 40 is shown coaxially disposed in the head portion 42 and extending from an end of the receptacle 37 into the mid-section of the head portion 42. Referring now back to FIG. 1, exit ports 44 are shown provided around the circumference of the head portion 42 that are in fluid communication with the passage 40 of FIG. 2.

Shown in both FIGS. 1 and 2 is a flexible insertion tip 45 mounted on the nozzle 34 and projecting generally away from the end of the flexible hose 22. Shown in FIG. 2 is an elongated flexible element 46 that has an end mounted within the head portion 42 of the nozzle 34. From the head portion 42, the flexible element 46 projects axially through a series of weighted spheres $\mathbf{48}_1 \ldots \mathbf{48}_N$. A flexible housing 50 provides a covering around the spherical head portion 42 and the spheres $\mathbf{48}_1 \ldots \mathbf{48}_N$. The flexible housing 50 attaches on the outer periphery of the last or lowermost sphere $\mathbf{48}_N$. Threaded fasteners 52 are as shown attaching the flexible housing 50 to both nozzle 34 and sphere $\mathbf{48}_N$. The material forming the flexible housing 50 can be permeable and allow well fluid through; or alternatively, made from an impermeable material that blocks fluid. In embodiments having an impermeable material, air or a substantially incompressible fluid can be put within the housing 50. Example materials for the flexible housing 50 include fabrics, polymers and other materials enabling lateral movement of the string of spheres $\mathbf{48}_1 \ldots \mathbf{48}_N$ that depend from the nozzle 34. Additionally, the fit between the housing 50 and spheres $\mathbf{48}_1 \ldots \mathbf{48}_N$ and nozzle 34 should be so that the outer surface of the flexible housing 50 can remain substantially continuous during use; that the flexible housing 50 should be relatively void of any undulations, thereby maintaining a smooth surface for ease of sliding across surfaces that may otherwise cause a snag thereon. Examples of snag prone surfaces include edges, corners, and the like.

The elongated flexible element 46, which can be a metal cable, also should be substantially flexible so that while the spheres $\mathbf{48}_1 \ldots \mathbf{48}_N$ are connected to one another, any portion of the string of spheres $\mathbf{48}_1 \ldots \mathbf{48}_N$ may flex radially outward in any angular direction (i.e. 0°-360° from the axis $A_X$ of the hose assembly. Additionally, the force required to shear or fracture the elongated element 46 should be less than that to shear or fracture other portions of the flexible hose assembly 20. More specifically, the insertion tip 45 can be fractured or sheared between the first sphere $\mathbf{48}_1$ and nozzle 34. By providing a weak point in the elongated element 46, the CAR hose assembly 20 can be removed from within a wellbore by exerting a pulling force to shear the elongated element 46 should the insertion tip 45 become snagged during use. Optionally, the elongated element 46 can be sheared by closing of a BOP valve.

Figure 3:
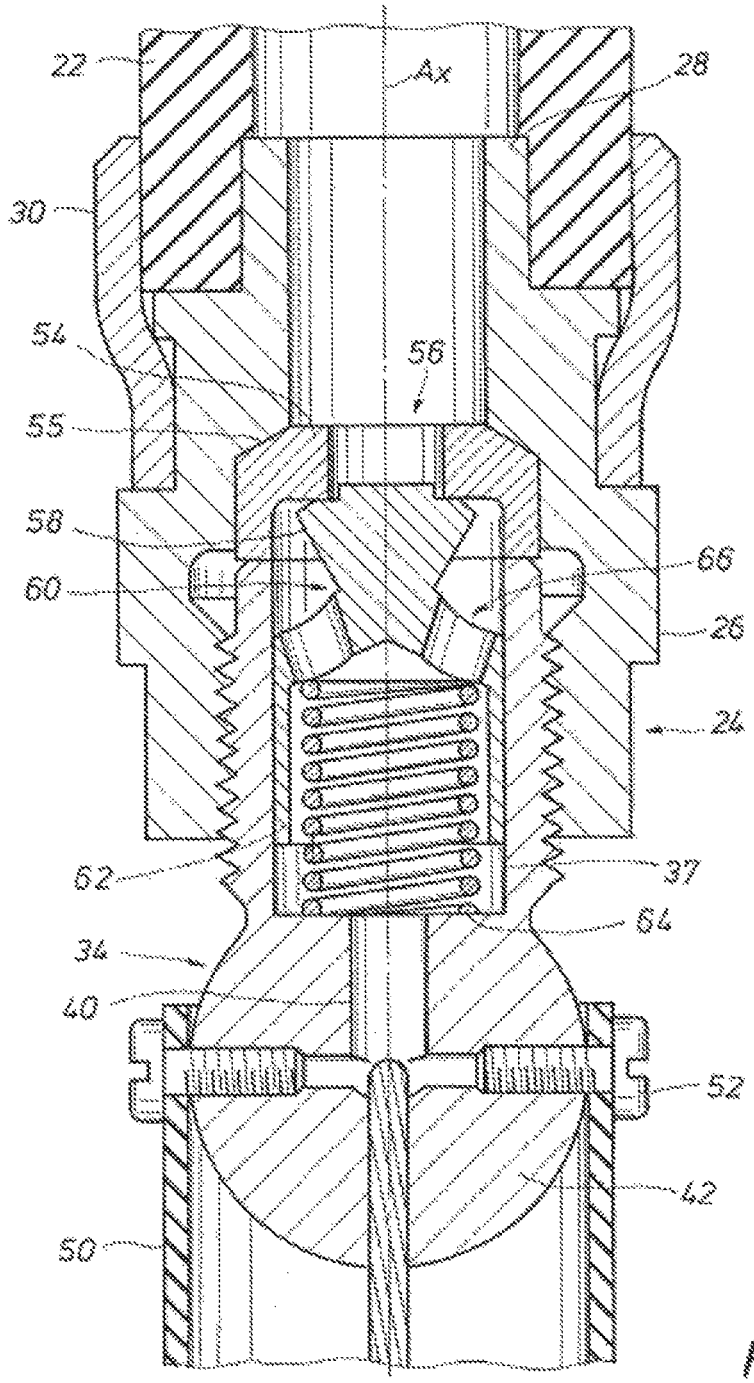
FIG. 3 is a sectional view of a valve assembly of the hose assembly of FIG. 1.

A detailed view of an example embodiment of the valve assembly 38 of FIG. 2 is illustrated in a side sectional view in FIG. 3. As shown, a bowl shaped valve seat 54 having an open and a closed end is provided within the body 26 of the fitting 24. The closed end of the valve seat 54 rests on a shoulder 55. A change of inner radius within the body 26 forms the shoulder 55. A valve inlet 56 is bored axially through the valve seat 54; in the embodiment of FIG. 3, a lower body 58 of a valve plug 60 is set in the end of the bore on the open end of the valve seat 54. The lower body 58 is a conically-shaped element having a portion shown protruding axially away from the remaining portions of the valve plug 60 and into the bore. The valve plug 60 further includes a generally annular upper body 62 having an open end that faces the passage 40. A spring 64 is provided within the open end of the upper body 62; the spring 64 provides a pushing force to urge the valve plug 60 and the lower body 58 into the bore to block the valve inlet 56. Accordingly, flow into and through the nozzle requires the pressure in the hose 22 to overcome the closing force provided by the spring 64 onto the valve plug 60. When fluid pressure overcomes the closing force of the spring 64, the lower body 58 is urged upward away from the inlet 56 so that fluid may enter into the receptacle 37. Once in the receptacle 37, the fluid is routed into an orifice 66 in the valve plug 60 shown where the upper and lower bodies 58, 62 are attached. Once within the orifice 66, fluid can flow through the receptacle 37, through the passage 40 and out of the valve through the exit ports 44 (FIG. 1). It should be pointed out, that in an example embodiment, the exit ports 44 discharge outside of the flexible housing 50 and not within. The flexible element 46 is substantially solid and blocks fluid flow therethrough.

An example of use of the CAR hose assembly 20 is illustrated in a side partial sectional view in FIG. 4. Here, the CAR hose assembly 20 is inserted within a wellhead assembly 68 from a hose reel 70. From the hose reel 70, the hose 22 is routed through an isolation valve 72 shown mounted on a low pressure housing 74. In the example of FIG. 4, the low pressure housing 74 makes up an outer surface of the wellhead assembly 68. A port 76 formed through the low pressure housing 74 registers with the passage through the isolation valve 72. After being inserted into the wellhead housing 68, continued feeding of the flexible hose 22 through the isolation valve 72 and port 76 lowers the insertion tip 45 into an annulus 78 shown defined between outer and inner casings 80, 82. Each of the outer and inner casings 80, 82 respectively depend from casing hangers 84, 86. From the example of FIG. 4, the casing hanger 84 mounts onto the low pressure housing 74 whereas the casing hanger 86 mounts to a high pressure housing 88 that is coaxially provided within the low pressure housing 74. A conically shaped path 90 is depicted in a dashed outline and around the insertion tip 45. The path 90 represents a space where the string of weighted spheres $\mathbf{48}_1 \ldots \mathbf{48}_N$ may be disposed if deflected by contact with a surface within the annulus 78. Thus, the weighted spheres $\mathbf{48}_1 \ldots \mathbf{48}_N$ are not limited to movement in a single plane but may enter any space circumscribing the axis $A_X$ of the CAR hose assembly 20.

Schematically shown in FIGS. 5A through 5C is an example of how the insertion tip 45 facilitates deploying and removing the CAR hose assembly 20 in and out of an annulus 78. With regard to FIG. 5A, in this example the CAR hose assembly 20 is lowered so that the lowermost tip of the insertion tip 45A contacts a surface 92 causing the insertion tip 45A to bend into the curved configuration of FIG. 5A from the substantially straight configuration of FIG. 4. As illustrated in FIG. 5B, continued lowering of the flexible hose 22 within the annulus 78 urges the insertion tip 45B towards the edge of the surface so that the lower end of the tip 45B extends downward within the annulus past the edge. Continued feeding flexible hose 22 into an annulus is illustrated in FIG. 5C where the insertion tip 45C is substantially elongate and the weighted members drag the entire assembly 20 past the edge of the surface 92, thereby facilitating insertion of the CAR hose assembly 20 within the annulus.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

What is claimed is:

1. A casing annulus remediation hose assembly comprising:

a hose with an exit and an inlet in selective fluid communication with a fluid supply;

a nozzle having a check valve that is selectively openable in response to pressure in the hose; and an insertion tip having an outer annular flexible housing that has an upper end coaxially attached to the nozzle and weighted members flexibly connected to one another that are in the housing and that are axially spaced away from one another.

2. The hose assembly of claim 1, wherein the flexible housing has an end connected to the nozzle and is substantially coaxial with each of the weighted members.

3. The hose assembly of claim 1, wherein the weighted members are spherical.

4. The hose assembly of claim 1, wherein the weighted members are spherical and are mounted on an elongated flexible element, and wherein the housing has a lower end that terminates proximate to and couples with a lowermost one of the weighted members, and wherein the outer surface of the housing defines a smooth and continuous surface between the nozzle and the lowermost one of the weighted members.

5. The hose assembly of claim 1, further comprising an elongated flexible element coupled to each of the weighted members and that is changeable from a substantially straight configuration to a curved configuration, wherein the hose has a yield strength that is greater than a yield strength of the flexible element.

6. The hose assembly of claim 5, wherein when the elongated flexible element is in the curved configuration at least one of the weighted members is selectively in any part of a space that circumscribes an axis of the hose assembly.

7. The hose assembly of claim 1, further comprising exit ports on an outer surface of the nozzle that are in fluid communication with the hose exit for discharging fluid from the hose, the interior of the housing being blocked from the exit ports.

8. The hose assembly of claim 1, further comprising a cable coupled to each of the weighted members.

9. The hose assembly of claim 1, wherein the housing comprises a fabric and has an inner surface that extends proximate to an outer periphery of each of the weighted members.

10. A method of remediating a tubular annulus of a well comprising:

providing a flexible hose having a lower end with a nozzle and an insertion tip depending from the nozzle comprising weighted spheres mounted in-line on an elongated flexible element and an annular flexible housing covering each of the spheres and the flexible housing having a continuous outer surface that extends from the nozzle and to a one of the spheres most distal from the nozzle;

inserting the insertion tip of the flexible hose through a wellhead assembly and into the tubular annulus;

passing a protuberance in the annulus by lowering the flexible hose so that the insertion tip flexes against the protuberance and drops downward lower within the annulus at an edge of the protuberance thereby guiding the lower end of the flexible hose past the protuberance; and pumping fluid through the hose that exits the nozzle above the insertion tip into the annulus.

11. The method of claim 10, further comprising withdrawing the flexible hose from the annulus so the insertion tip contacts and slides past the edge of the protuberance.

12. The method of claim 10, further comprising shearing the insertion tip from the nozzle when the insertion tip becomes lodged within the annulus.

13. The method of claim 10, wherein the step of inserting the insertion tip comprises flexing the insertion tip from a substantially straight configuration with the weighted spheres substantially aligned with a nozzle axis, to a curved configuration.

14. A tubular annulus remediation assembly for injecting a fluid into a tubular annulus of a wellhead assembly comprising:

an isolation valve adapted to be mounted to the wellhead assembly over an opening through the wellhead assembly;

a hose mounted to a reel for insertion through the isolation valve into the tubular annulus;

an upper end of the hose in selective fluid communication with a fluid supply;

a nozzle on a lower end of the hose; and a flexibly connected string of weighted members having an upper end flexibly depending from the lower end of the nozzle;

an outer tubular flexible housing covering the weighted members and having a substantially smooth and continuous unsegmented outer surface; and exit ports on the nozzle that lead to an exterior of the housing.

15. The assembly of claim 14, wherein at least one of the weighted members is substantially spherical.

16. The assembly of claim 14, further comprising a flexible cable on which each weighted member is attached.

17. The assembly of claim 14, further comprising exit ports on the nozzle that are in fluid communication with the hose.

18. The assembly of claim 14, wherein the interior of the housing is isolated from the discharge of the nozzle.

19. The assembly of claim 14, wherein the interior of the housing is sealed from an exterior of the housing and from an interior of the hose.

* * * * *